US005762857A

United States Patent [19]

Weng et al.

[11] Patent Number: 5,762,857

[45] Date of Patent: Jun. 9, 1998

[54] METHOD FOR PRODUCING NONWOVEN WEB USING PULSED ELECTROSTATIC CHARGE

[76] Inventors: Jian Weng, 4603 Hunters Point Ct., Charlotte, N.C. 28269; Mark Francis Jones, 109 Chatworth La., Mooresville, N.C. 28115; Mark Allen Anderson, 4600 Chiswell Ct., Charlotte, N.C. 28269

[21] Appl. No.: 794,236

[22] Filed: Jan. 31, 1997

[51] Int. Cl.[6] ..... D01D 5/08; D04H 3/00

[52] U.S. Cl. ..... 264/465; 264/70; 264/103; 264/210.8; 264/469; 264/555

[58] Field of Search ..... 264/70, 103, 210.8, 264/465, 469, 555

[56] References Cited

U.S. PATENT DOCUMENTS

| | | | |
|---|---|---|---|
| 3,163,753 | 12/1964 | Sabato et al. | 250/324 |
| 3,296,678 | 1/1967 | Bundy et al. | 28/104 |
| 3,302,237 | 2/1967 | Cope et al. | 226/91 |
| 3,325,906 | 6/1967 | Franke | 226/7 |
| 3,338,992 | 8/1967 | Kinney | 264/465 X |
| 3,341,394 | 9/1967 | Kinney | 442/366 |
| 3,485,428 | 12/1969 | Jackson | 226/97 |
| 3,502,763 | 3/1970 | Hartmann | 264/555 |
| 3,655,305 | 4/1972 | Baxter et al. | 425/174.8 E |
| 4,009,508 | 3/1977 | Sternberg | 19/299 |
| 4,163,305 | 8/1979 | Semjonow et al. | 19/299 |
| 5,397,413 | 3/1995 | Trimble et al. | 156/167 |

*Primary Examiner*—Leo B. Tentoni

*Attorney, Agent, or Firm*—Juettner Pyle Piontek & Underwood

[57] ABSTRACT

A method and apparatus is provided to cause deflection or oscillation of a bundle of spun thermoplastic filaments. A pulsing electrostatic charge and optionally an additional constant charge is applied to attenuated filaments prior to deposit of the filaments on a conveyor in the form of a web. Adjacent sections of filaments may be charged with different phases, and multiple pulsed charges may be applied. The pulsed charges cause movement or oscillation of the filaments resulting in better web uniformity.

12 Claims, 5 Drawing Sheets

METHOD FOR PRODUCING NONWOVEN WEB USING PULSED ELECTROSTATIC CHARGE

BACKGROUND OF THE INVENTION

The invention relates to a method for making a nonwoven web from polymer filaments and more particularly to a method in which continuous filaments of thermoplastic polymer are continuously extruded and subjected to an electrostatic charge to cause separation of the filaments before they are formed into a web.

Spunbonded webs are typically made by continuously extruding a bundle of monofilaments, quenching and attenuating the filaments, and then depositing the filaments on a moving support to form a web.

The application of a uniform electrostatic charge to the filaments to cause repulsion and separation and to provide for better web uniformity is well known. U.S. Pat. No. 3,338,992 describes a process in which a multifilament strand, while under tension, is electrostatically charged by a corona discharge device. The charged filaments are then forwarded by means of a jet toward a web laydown zone, with the tension on the filaments being released upon exist from the jet, permitting the filaments to separate due to the repelling effect of the applied electrostatic charge. Related techniques are described in U.S. Pat. Nos. 3,163,753, 3,341,394 and 4,009,508, in which the filaments are attenuated in round tubes.

In order to improve productivity of the spunbond process, more recent improvements in spunbond technology have involved the use of slot attenuators, such as described in U.S. Pat. No. 3,502,763. In a slot drawing process, the filaments pass through a tapered slot, which is coextensive with the width of the machine or take off conveyor. The filaments produced by the spinnerets are fed into the slot and are attenuated by a high flow of air in which a venturi effect is created to accelerate the air flow and cause elongation of the filaments. The filaments then exit the slot and are deposited on a moving conveyor in the form of a web.

U.S. Pat. No. 5,397,413 discloses a slot drawing device in which electrodes are mounted within the body of the attenuator near the outlet exit of the slot. A uniform electrostatic charge is applied to the filaments while under tension within the attenuator, and the filaments tend to separate upon exit from the slot. While some improvements are afforded, the filaments nearest the electrodes block the filaments in the middle, and this results in the application of a non-uniform charge. Also, the filaments tend to be deposited more in the machine direction, resulting in less strength in the cross machine direction.

Manufacturers of spunbonded nonwoven fabrics have long sought to achieve high production speeds without sacrifice to web uniformity. Non-uniformity is especially a troublesome problem when producing low basis weight fabrics. The most desirable fabrics have good strength in the machine and cross machine direction, uniform and even spacing of the filaments, and a random laydown in which the filaments do not extend in parallel to a significant degree.

In view of the fact that the filaments are extruded and drawn in parallel, many other proposals have been advanced to disrupt the parallel pattern into a more random or oscillating pattern, especially to improve strength in the cross machine direction. Various mechanical and pneumatic methods have been proposed, such as described in U.S. Pat. Nos. 3,296,678, No. 3,485,428 and 4,163,305. These devices, however, generally increase the complexity and cost of the manufacturing process and may impose a limit on production speeds.

SUMMARY OF THE INVENTION

In accordance with the present invention, a nonwoven web is made from a plurality of extruded polymer filaments, and the filaments are randomized by subjecting them to a pulsed or irregular electrostatic charge. The filaments, which are moving in a primary direction toward a collection zone, are passed adjacent high voltage electrodes having a pulsed signal. This results in intervals of greater and lesser charge on the filaments and random deflection of the filaments at angles relative to the primary direction. The filaments are repeatedly deflected to cause sinusoidal motion of the filaments and oscillation of the filament stream.

Preferably, adjacent groups of filaments are provided with pulsed charges of the same polarity but at different phases such that the oscillation of one group is out of phase with an adjacent group. This provides better interdispersion between adjacent groups and even better uniformity and distribution of filaments in the resulting web. Also, preferably, the filaments are provided with some degree of constant (DC) charge to provide some basic amount of constant repulsion.

The electrostatic charge is provided across the moving filaments simultaneously by a plurality of high voltage electrodes which are preferably located downstream of the zone in which the filaments are being attenuated by air flow or otherwise. The pulse frequency and amplitude can be adjusted to vary the period or degree of oscillation of the filaments. The randomized filaments are then deposited on a moving support to provide a continuous flat web.

The method of the present invention provides a relatively simple and inexpensive way to produce nonwoven webs of extremely good uniformity at lower basis weights and high production speeds, allowing significant reductions in direct production costs. The method and apparatus of the invention also avoids the need to employ complicated auxiliary devices to control filament distribution, such as mechanical and air jet devices.

DETAILED DESCRIPTION

Figure 1:
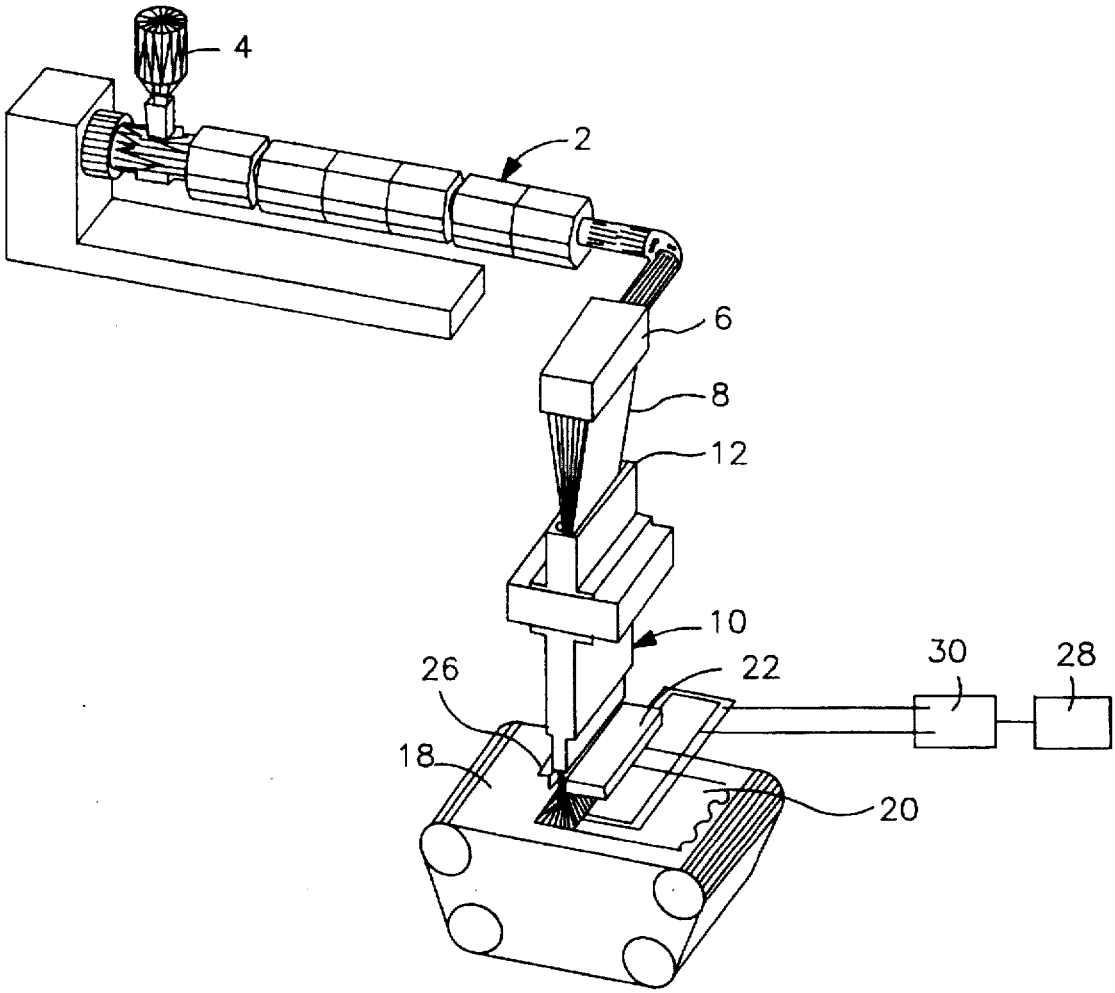
FIG. 1 is a perspective schematic view of the apparatus for carrying out the method of the present invention.
Figure 2:
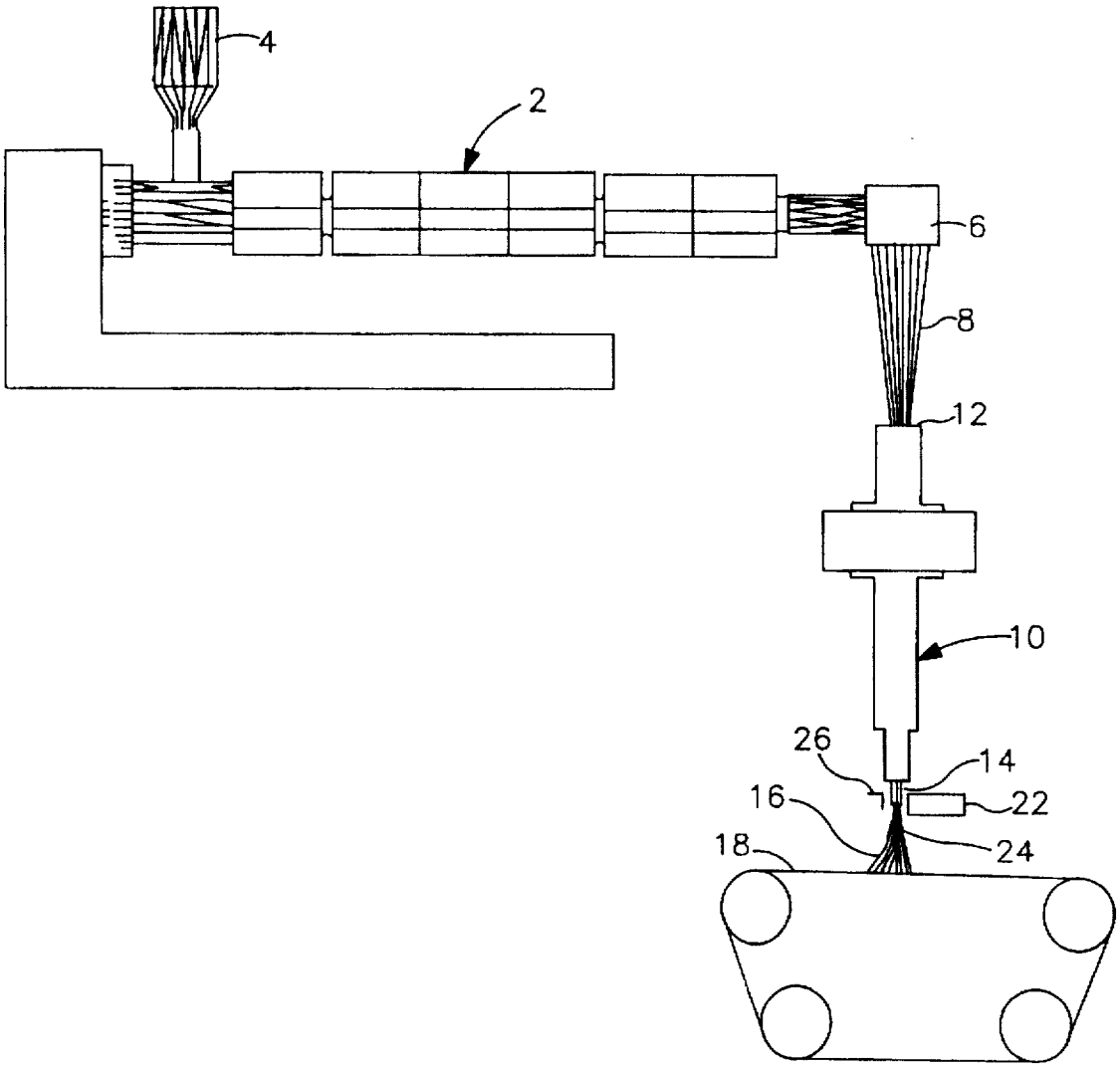
FIG. 2 is a side view of the apparatus shown in FIG. 1.
Figure 3:
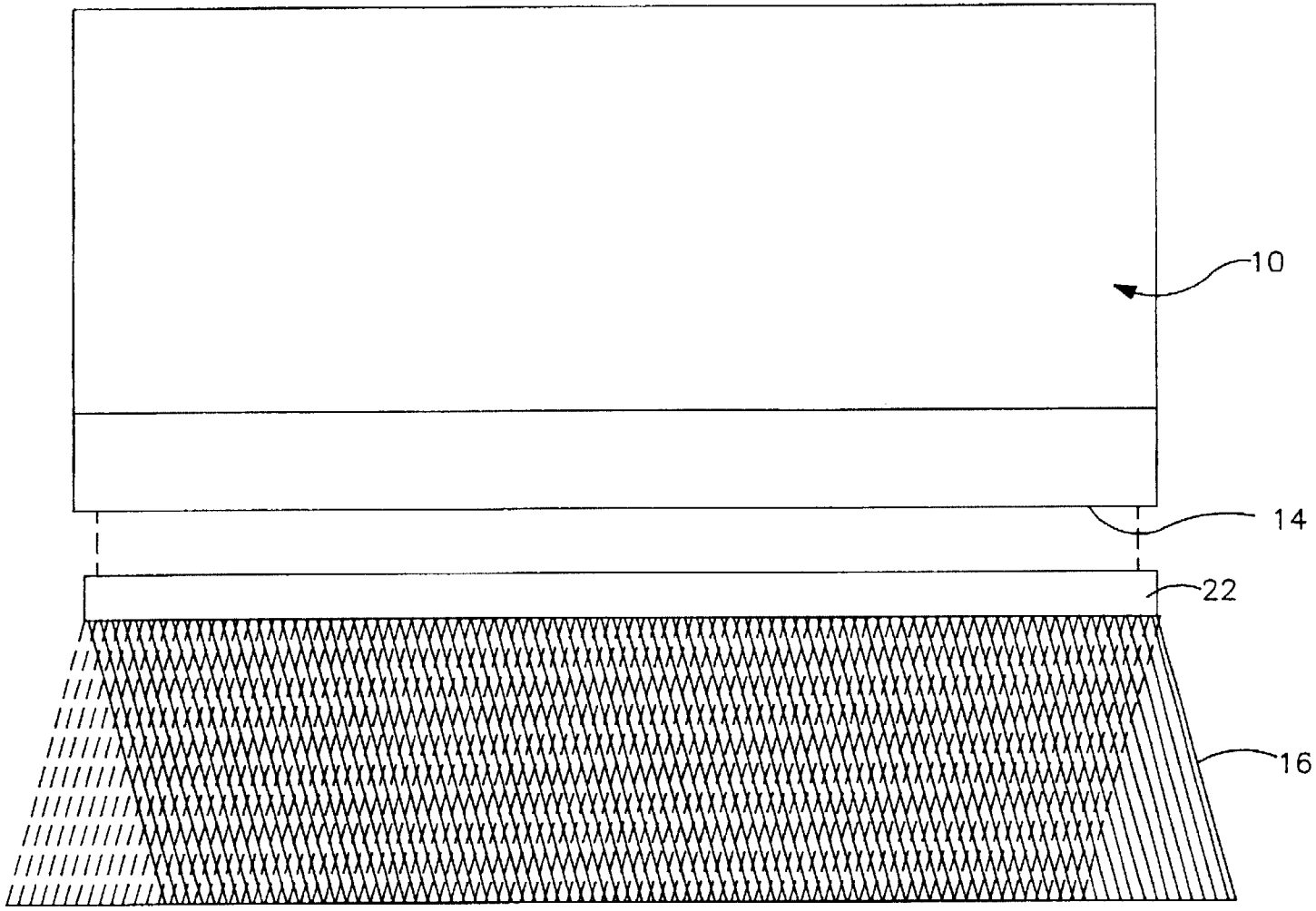
FIG. 3 is a partial front view of the apparatus shown in FIG. 1.

FIGS. 1–3 schematically show a slot drawing device used in a process for making spunbonded nonwoven webs. Such devices are described in detail in U.S. Pat. Nos. 3,302,237, 3,325,906, 3,655,305, 3,502,763 and 5,397,413, incorporated herein by reference.

In general, a solid granulated thermoplastic resin such as polypropylene is introduced into a heated and pressurized extrusion device 2 through an inlet or hopper 4, and the molten thermoplastic is fed under pressure into a head 6 having a plurality of lines and rows of orifices or spinnerets, causing extrusion of a plurality or bundle of spaced filaments 8. The filaments are introduced into the inlet opening 12 of a slot draw attenuator 10. The attenuator 10 comprises a downwardly tapering passage, and a high velocity flow of air is also forced downwardly, causing elongation or attenuation of the filaments, which are shown beyond the exit 14 of the slot 10 at 16. Upon exit from the slot device 10, the solid filaments are free of any substantial tension and are deposited on a moving conveyor 18 to form a continuous web 20. The web 20 is typically further processed, such as by bonding and by rolling up into a finished roll.

The present invention is not limited to any particular method of filament formation, as long as the filaments to be processed are arranged in a generally parallel arrangement and preferably in one or more lines, such as is available from the slot drawing device. As will be described hereinafter in detail, the electrostatic treatment of the filaments can take place in a zone after the filaments have been completely attenuated and are not under any significant tension. The invention is also applicable to any polymer capable of being spun into filaments and capable of holding an electrostatic charge, with polyolefins such as polyethylene and polypropylene and polyesters being most commonly employed.

As shown in FIGS. 1–3, an electrode bar 22, made of a high dieletric material, such as a polycarbonate resin, is positioned beyond or beneath the slot exit 14 and is coextensive with the width of the row of filaments 16. The bar 22 has an electrode face 24 which is slightly spaced from the filaments 16 on a first side thereof. A grounded conductive element or bar 26 is spaced from the row of filaments 16 on the other side thereof, said conductive element being opposed to and coextensive with the electrode bar 22. The two parts 22 and 26 therefore provide an open gap through which the filaments 16 may pass and receive a charge during passage. Preferably, the entrance to the gap is at a distance in the order of from about 0.25 to about 5 inches below the exit 14 of the attenuator 10.

As shown in FIG. 1, the electrode bar 22 is electrically connected to a high voltage power supply 28 through a control unit 30. The power supply 28 preferably has a variable voltage setting of up to 30 kv with negative polarity. The control unit 30 includes a pulse control with variable pulse frequency and a splitter to divide the pulse into at least two different phases. The control unit 30 also provides an adjustable degree of a constant DC negative voltage and a pulsed negative voltage. Preferably, the AC or pulsed voltage is about 40 to 60 percent of the constant DC voltage.

Figure 4:
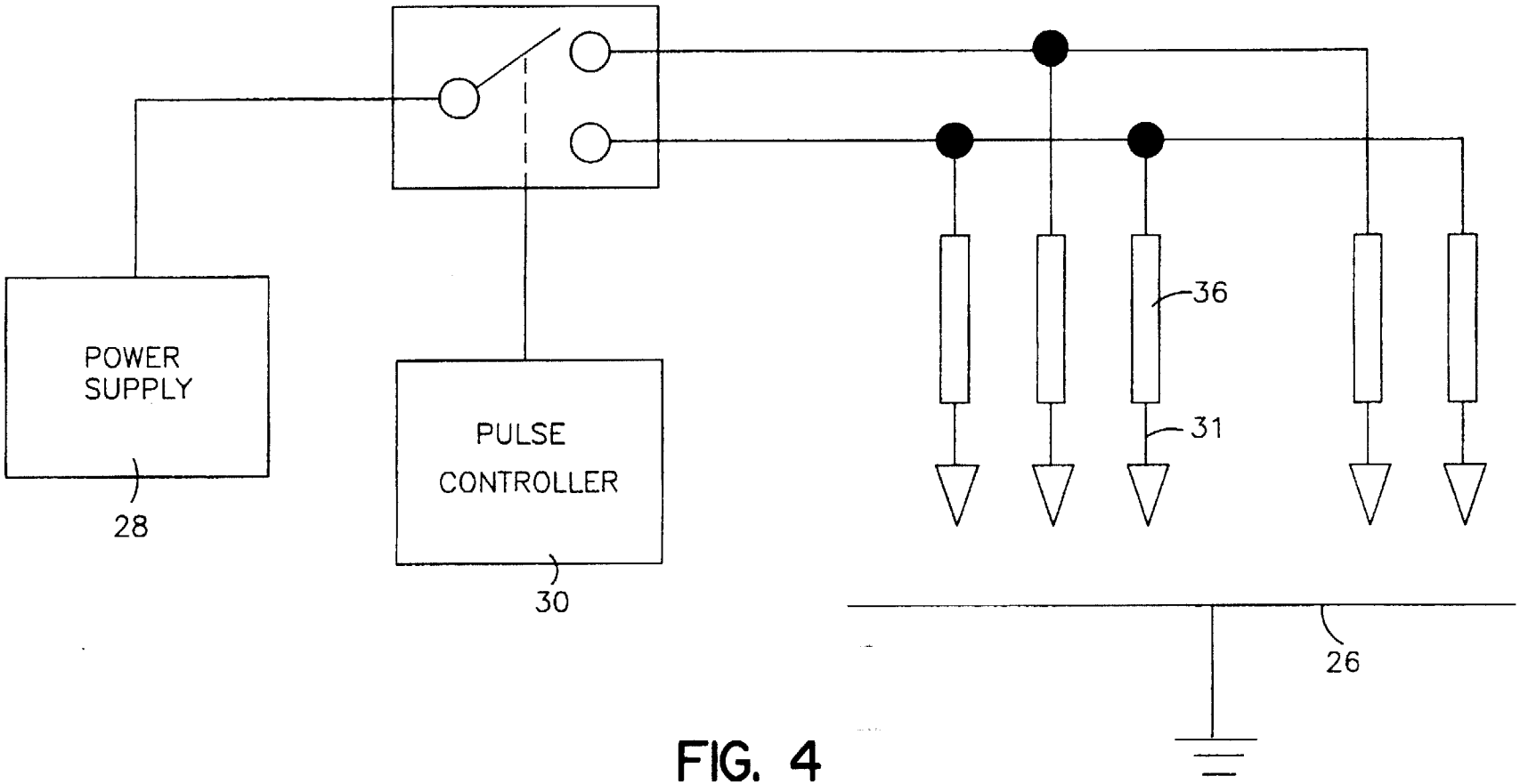
FIG. 4 is a schematic of a circuit for providing a pulsed voltage to a plurality of electrodes.
Figure 5:
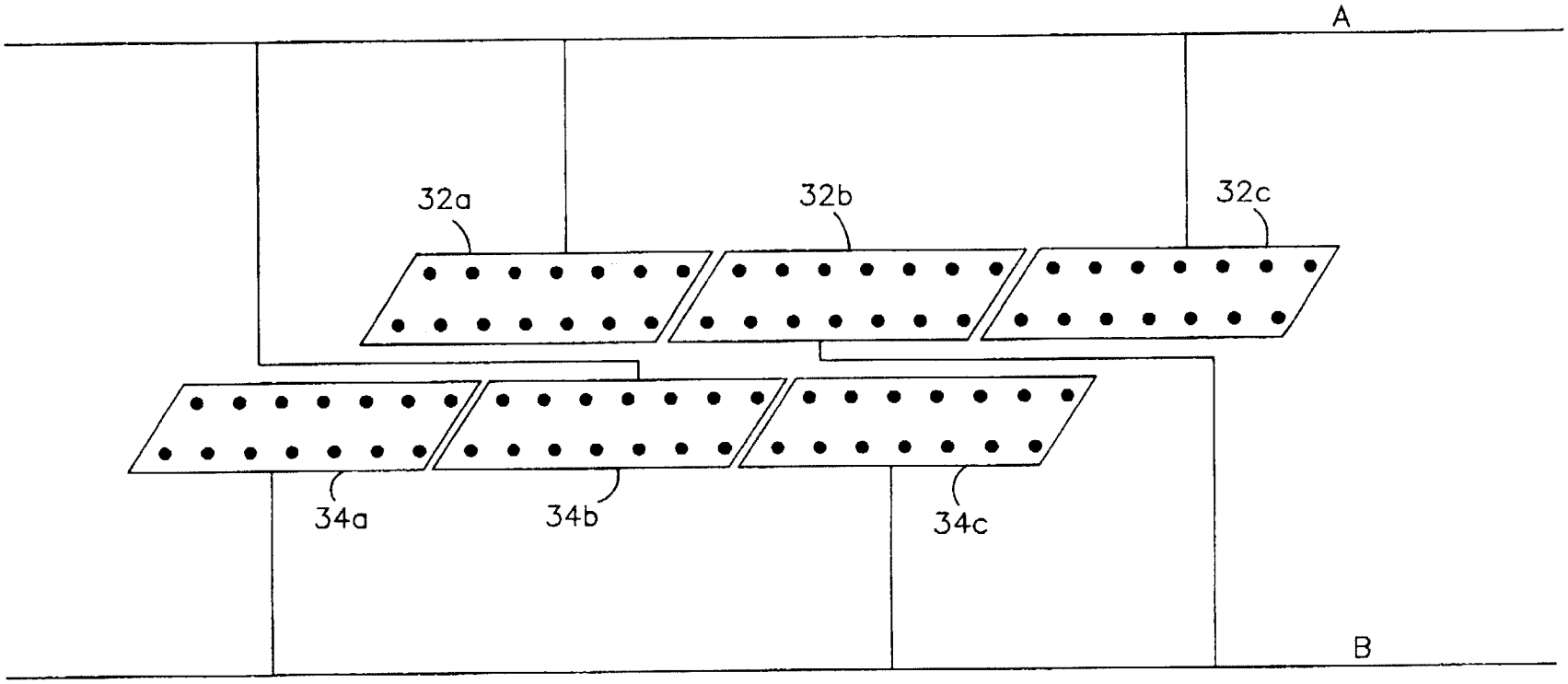
FIG. 5 is a schematic view of an electrode array which may be employed in connection with the present invention.

FIGS. 4 and 5 show the elements for providing a corona discharge. As shown in FIG. 5, the electrode block 22 includes at least one row of electrodes 31 asegregated into a plurality of cells, such as 32*a*, 32*b* and 32*c*. The electrodes in each cell are preferably in a saw tooth or w-shaped pattern and are closely spaced to provide a high charge density. Second and additional lines of cells may be provided, beneath the first line, such as the line formed by cells 34*a*, 34*b* and 34*c*. Each electrode 30 and its associated series resistor 36 of each cell in each line is alternatively connected to the pulsed power supply at the same intensity but at different phases. If the two phases are identified as A and B as shown in FIG. 5. The outermost cells in the first line, 32*a* and 32*c*, are connected to phase A, and the central cell 32*b* is connected to phase B. In the second line 34, the phase connections are reversed, and the outer cells are connected to phase B.

From initial studies, it has been found that most satisfactory results are obtained if the pulses in lines A and B are 180° out of phase. The pulse frequency can be widely adjustable, e.g., from about 0.5 Hz to 100 Hz. From initial studies, good results on polypropylene filaments are obtained in the range of from about 2 to about 10 Hz. Obviously, various groups of electrodes could be caused to operated at different frequencies and phases to cause a variety of types of movements of the filaments.

Since the power supply 28 is a DC source, only a portion of the voltage is pulsed, so that a constant DC is supplied to the electrodes with the added pulsed supply. Thus, the filaments will be provided with a constant base charge as well as an added pulsed charge of the same polarity.

In operation, the electrode bar 22 is supplied with high voltage, and an electrostatic field is established between the bar and ground 26. If the field is pulsed, the filaments 16 are deflected at an angle away from the normal line of travel. Repeated pulsing causes the filaments to oscillate back and forth by an electric wind. A substantial amount of this movement is in the cross machine direction, or in a direction perpendicular or at obtuse angles relative to the direction of movement of the conveyor 18 as shown in FIG. 1. By oscillating the filaments in the cross machine direction, the tensile strength of the resulting fabric in the same direction is greatly improved.

In addition, if adjacent groups are pulsed at opposite phases, they will oscillate toward and away from each other, which results in better interdispersion and improved uniformity. The use of two or more rows of electrodes in this fashion results in a laydown of the filaments in a randomized uniformly spaced manner solely by use of electrostatic forces.

With reference to FIG. 5, it may be seen that the second row 34 of electrode cells are in staggered relation with the first row 32, with a reversed order of phase. This causes additional overlap or mixing of the filaments between cells by dividing the previously charged filaments in one phase into charges of opposite phases. The treatment easily allows enhancement of the CM/MD tensile strength ratios, with a 2.6:1 ratio being obtained at 5 Hz.

In summary, the electrostatic treatment of the filaments comprises three components. A constant DC charge is applied to the filaments to cause constant repulsion therebetween, irrespective of position. A pulsing charge of the same polarity as the DC charge is applied to deflect the filaments back and forth at angles relative to the normal path of travel. The charge applied to one group of filaments is out of phase with the charge applied to a second adjacent group, causing the groups to deflect toward and away from each other.

As a result of the above electrostatic treatment, the filaments are uniformly repelled from each other and are also oscillated, with adjacent groups being oscillated in different directions.

What is claimed is:

1. Method for producing nonwoven web from continuous filaments, said method comprising the steps of extruding a plurality of filaments, moving said filaments in a first direction toward a collection zone, and applying a pulsed electrostatic charge at a frequency across said filaments to deflect said filaments at an angle relative to said first direction, and then collecting said filaments in the form of a nonwoven web.

2. The method of claim 1 wherein a constant DC charge and a pulsed charge of the same polarity is applied to said filaments.

3. The method of claim 1 wherein said pulsed electrostatic charge is applied in alternating different phases across said filaments.

4. The method of claim 3 wherein said different phases are 180° out of phase.

5. The method of claim 1 wherein said filaments are attenuated in an attenuator having an entrance and exit, and said pulsed electrostatic charge is applied beyond said exit.

6. The method of claim 1 wherein said pulsed electrostatic charge is applied at a distance of from about 0.25 to about 5 inches from said exit.

7. The method of claim 1 wherein said pulsed electrostatic charge is applied across said filaments along a first and at least a second successive line.

8. The method of claim 1 wherein said frequency is in the order of from about 0.5 to about 100 Hz.

9. The method of claim 2 wherein the ratio of the constant DC charge and pulsed charge are adjustable in intensity relative to each other.

10. The method of claim 1 wherein said filaments are a solid monoplastic material.

11. The method of claim 10 wherein said filaments comprise polypropylene.

12. The method of claim 1 wherein multiple pulsed charges are applied to said filaments.

* * * * *